US006354756B1

(12) United States Patent
Morita

(10) Patent No.: US 6,354,756 B1
(45) Date of Patent: Mar. 12, 2002

(54) INK STORAGE TUBE FOR BALL-POINT PENS

(75) Inventor: Masaaki Morita, Gunma (JP)

(73) Assignee: Mitsubishi Pencil Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/701,169

(22) PCT Filed: May 26, 1999

(86) PCT No.: PCT/JP99/02775

§ 371 Date: Nov. 22, 2000

§ 102(e) Date: Nov. 22, 2000

(87) PCT Pub. No.: WO99/61257

PCT Pub. Date: Dec. 2, 1999

(30) Foreign Application Priority Data

May 26, 1998 (JP) ..... 10-144757

(51) Int. Cl.[7] ..... A46B 11/00

(52) U.S. Cl. ..... 401/222; 401/195; 401/194; 401/192

(58) Field of Search ..... 401/222, 221, 401/192, 141, 142, 194, 195

(56) References Cited

U.S. PATENT DOCUMENTS 5,984,556 A * 11/1999 Gray et al. ..... 401/192

FOREIGN PATENT DOCUMENTS

| | | | |
|---|---|---|---|
| JP | 59-90487 | 6/1984 | ..... B43K/7/02 |
| JP | 03019897 | 1/1991 | ..... B43K/7/02 |
| JP | 6-81788 | 11/1994 | ..... B43K/7/06 |

* cited by examiner

*Primary Examiner*—David J. Walczak
(74) *Attorney, Agent, or Firm*—Darby & Darby

(57) ABSTRACT

An ink reservoir which can allow a visual color to display a blue color without coloring the ink reservoir with a specific colorant.

It is an ink reservoir for a ball point pen, in which fine particles for scattering light are contained in a resin composing the ink reservoir for a ball point pen and which makes it possible to transmit light.

11 Claims, 2 Drawing Sheets

INK STORAGE TUBE FOR BALL-POINT PENS

This is a national phase application under 35 U.S.C. §371 of International Application No. PCT/JP99/02775, filed May 26, 1999, and claims the benefit under 35 U.S.C. §119 of Japanese Patent Application No. Hei 10-144757, filed May 26, 1998.

TECHNICAL FIELD

The present invention relates to an ink reservoir for a ball point pen which can display a visual ink color and a ball point pen using the same.

BACKGROUND ART

A ball point pen comprises a ball, a tip for holding the same and a tube, which is connected with the tip and filled with an ink. The ball point pen feeds the ink to the ball through the tip and coats the ink (writes) on a paper surface. It is a matter of course that since the tip and the tube are fine, a holder which fixes the above tip and which has a size suitable for writing with fingers is installed to constitute the ball point pen.

This tube is an ink reservoir, and transparent or translucent ones are used in many cases so that an ink decrement due to use of the ink can be observed.

An ink for a ball point pen, particularly an oil based ink for a ball point pen is compounded with a large amount of colorants, and when the colorant is dyes, an appearance of the ink color displays apparently a color almost close to black even when, for example, a black, red, blue or green ink is used.

When a pigment is used, a visual color of a blue or dark-blue ink of a cool color, apart from an ink having a warm color displays a color almost close to black since the ink absorbs almost all of light.

Further, it is possible to obtain, for example, a red, blue or green translucent ink reservoir by coloring the ink reservoir. A translucent red, blue or green color can be observed in a part where the ink is not present, but a part where the ink is present displays a color almost close to black. In addition thereto, such colored ink reservoir is not used for various ink colors.

Accordingly, there has been a problem in that when a conventional ink reservoir for a ball point pen in which coloring is not given to the ink reservoir itself is filled with an ink, a visual color thereof is a dark color in all cases and it is difficult to distinguish them from each other.

DISCLOSURE OF THE INVENTION

An object of the present invention is to obtain an ink reservoir which can allow a visual color to display a blue color without coloring the ink reservoir with a specific colorant.

1. An ink reservoir for a ball point pen, in which fine particles for scattering light are contained in a resin composing the ink reservoir for a ball point pen and which makes it possible to transmit light.
2. The ink reservoir for a ball point pen as described in the above item 1, wherein the fine particles dispersed in the resin composing the ink reservoir have an average particle diameter of 100 nm or less.
3. The ink reservoir for a ball point pen as described in the above item 1 or 2, wherein the ink reservoir is made of polypropylene.

4. The ink reservoir for a ball point pen as described in the above item 2, wherein the fine particle which is dispersed in the resin composing the ink reservoir and which has an average particle diameter of 100 nm or less is titanium oxide.
5. A ball point pen using the ink reservoir for a ball point pen as described in any one of the above items 1, 2, 3 and 4, wherein the ink filled into the ink reservoir of the ball point pen is an oil based ink for a ball point pen.
6. The ball point pen as described in the above item 5, wherein the oil based ink for a ball point pen filled into the ink reservoir is a blue ink.

BEST MODE FOR CARRYING OUT THE INVENTION

Figure 2:
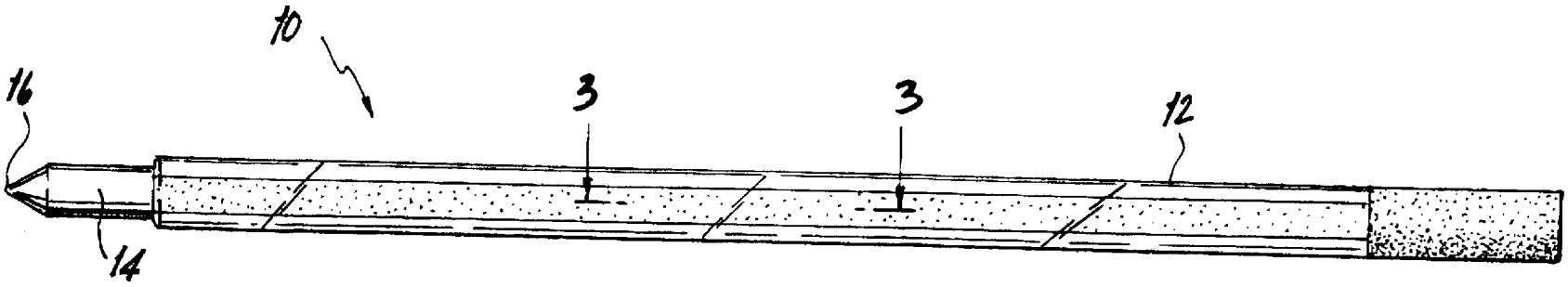
FIG. 2 is one embodiment of a ball point pen of the present invention.
Figure 3:
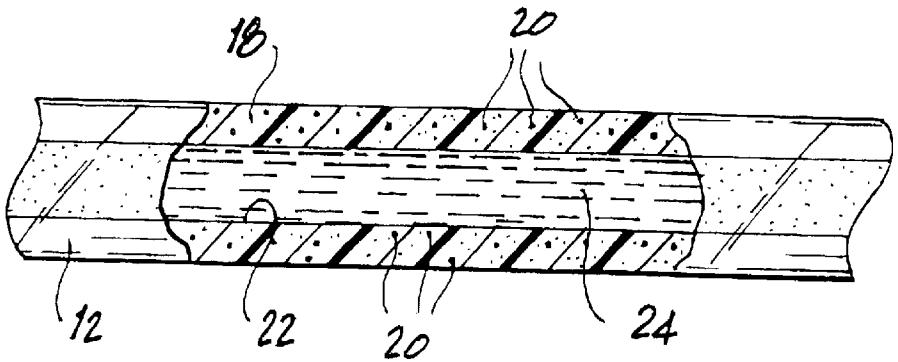
FIG. 3 is a partial sectional view of the ball point pen shown in FIG. 2.

The ball point pen of the present invention is exemplified in FIGS. 2 and 3. As shown in FIG. 2, the ball point pen (10) comprises a ball (16), a tip (14) for holding the same and a body (12), which is connected to the tip. An ink reservoir (22) is contained within the body (12) and comprises a resin (18) and particles (20) dispersed therein. The ink reservoir (22) holds an ink (24).

The fine particles for scattering light used in the present invention have preferably a size smaller than a wavelength of a visible ray and may be, for example, preferably particles of a resin such as polystyrene base resins, polystyrene-acryl base copolymers, acryl base resins, and inorganic powder such as fine powder silica, titanium oxide, zinc white and lead white.

The fine particles having an average particle diameter of 100 nm or less are most preferred. Fine particle titanium oxide can be used as the fine particles, and fine particle titanium oxide used in the present invention has suitably an average diameter of a single particle of 100 nm or less determined by an electron microscope method, and commercial products thereof include MT-500B, 500SA, 500HD, 600B, 600SA, 100S and 150W (all manufactured by TAYCA CORPORATION). They have a particle diameter of about 50 to 15 nm determined from a specific surface area based on the assumption that they are spheres. In addition thereto, capable of being used are TTO-55 (A) and TTO-55 (B) (C) (D) (S) (N) (B) (D) (all manufactured by ISHIHARA SANGYO KAISHA LTD.), Super Titania F-1, 2, 3, 4, 5 and 6 and surface-treated products thereof (all manufactured by SHOWA DENKO K.K.), and P-25 (manufactured by Degussa AG.).

A material for the ink reservoir used in the present invention may be any one as long as it has a resistance to a ink for a ball point pen filled without deforming or swelling and is so transparent that an amount of the ink filled can be observed. To be specific, capable of being used are thermoplastic resins such as polypropylene, polyethylene, polyacrylonitrile base thermoplastic resins, polyethylene terephthalate, polyarylate and ethylene-vinyl alcohol copolymers. In particular, polypropylene is suited since it is inexpensive and has a transparency and suitable strength and hardness.

It does not matter whether the ink for a ball point pen used in the present invention is a water based ink or an oil based ink, and a preferred example is an oil based ink for a ball point pen which contains a large amount of colorants and in which a visual color of the ink is dark. More preferred is a blue ink which displays the same color between the visible color of the ink reservoir for a ball point pen in which the particles for scattering light is contained according to the present invention and which can transmit light and the color of the drawn lines.

It is considered that since the fine particles are contained and dispersed in the resin of the ink reservoir, a scattered light having a wavelength in a short wavelength (400 to 500 nm) side of a visible ray is more strongly scattered and that since the ink filled has a dark color, an appearance of the ink reservoir displays a blue color.

The present invention shall more specifically be explained below with reference to examples, but the present invention shall by no means be restricted to these examples.

EXAMPLE 1

A polypropylene resin which was mixed with 0.1% by weight of fine particle titanium oxide MT-500HD was extrusion-molded to obtain a thin, white translucent tube (A) having an outer diameter of 3 mm and an inner diameter of 1.6 mm.

EXAMPLE 2

A propylene resin which was mixed with 0.2% by weight of fine particle titanium oxide MT-500SA was extrusion-molded to obtain a thin, white translucent tube (A2) having an outer diameter of 3 mm and an inner diameter of 1.6 mm.

COMPARATIVE EXAMPLE 1

Molding was carried out in the same manner as in Example 1, except that fine particle titanium oxide was excluded to obtain a translucent tube (B) having an outer diameter of 3 mm and an inner diameter of 1.6 mm.

These tubes (A), (A2) and (B) were charged with a blue ink (C) and a red ink (D).

The blue ink (C) was obtained by stirring the following blending components at 60° C. for 6 hours.

| Blue ink (C): | |
|---|---|
| 2-Phenoxyethanol | 35.0% by weight |
| Benzyl alcohol | 26.5% by weight |
| Polyvinylpyrrolidone | 0.5% by weight |
| S. P. T. Blue-111 (dye, manufactured by HODOGAYA CHEMICAL CO., LTD.) | 30.0% by weight |
| Oleic acid | 2.0% by weight |
| Hilac 110H (ketone resin manufactured by Hitachi Chemical Co., Ltd.) | 6.0% by weight |

| Red ink (D): | |
|---|---|
| 2-Phenoxyethanol | 41.5% by weight |
| Benzyl alcohol | 15.0% by weight |
| Polyvinylpyrrolidone | 0.5% by weight |
| Spilon Yellow C-2GH (dye, manufactured by HODOGAYA CHEMICAL CO., LTD.) | 5.0% by weight |
| Spilon Red C-GH (dye, manufactured by HODOGAYA CHEMICAL CO., LTD.) | 16.0% by weight |
| Oleic acid | 2.0% by weight |
| Hilac 110H (ketone resin manufactured by Hitachi Chemical Co., Ltd.) | 20.0% by weight |

the example tube (A) (A2) and the comparative example tube (B) were charged with the blue ink (C) and the red ink (D) respectively, and mounted with a ball point tip with a ball having a diameter of 0.7 mm to obtain ball point pens, whereby the following samples were prepared.

Sample 1: tube (A) of Example 1+blue ink (C)

Sample 2: tube (A2) of Example 2+red ink (D)

Sample 3: tube (B) of Comparative Example 1+blue ink (C)

Sample 4: tube (B) of Comparative Example 1+red ink (D)

Samples 1 to 4 had the colors thereof visually observed by 20 monitors under D65 standard light source F65D-A type (manufactured by Suga Test Instruments Co., Ltd.). The results thereof are shown in Table 1.

TABLE 1

| | Response/ blue | Response/ black | Uncertain |
|---|---|---|---|
| Sample 1/example | 20 | 0 | 0 |
| Sample 2/example | 18 | 0 | 2 |
| Sample 3/comparison | 0 | 20 | 0 |
| Sample 4/comparison | 0 | 19 | 1 |

A 150ϕ integrating sphere (manufactured by Hitachi, Ltd.) for U3300 was installed to a spectrophotometer U3300 (manufactured by Hitachi, Ltd.) to determine spectral reflectances of Samples 1 to 4 under the following conditions:

Conditions:

Data mode: % T

Scanning speed: 600 nm/min

Wavelength range: 800.00 to 400.00 nm

Slit: 5.0 nm

Base line correction: aluminum oxide plate

Sampling interval: 2 nm

Figure 1:
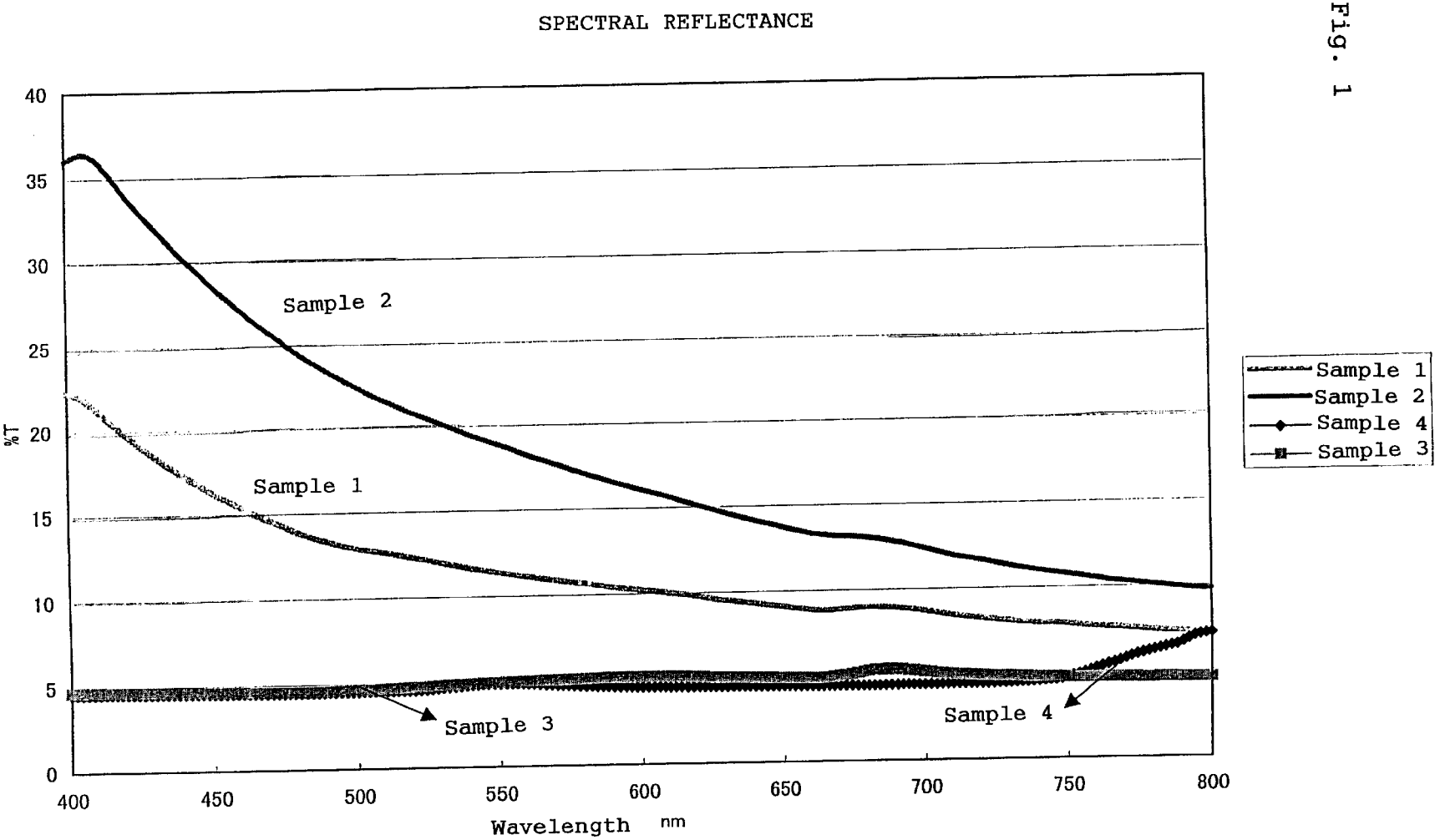
FIG. 1 is a drawing showing the spectra of Samples 1 to 4.

The spectra of Samples 1 to 4 are shown in FIG. 1. Peaks of blue reflected light are found in Samples 1 and 2 using the tubes (A and A2) prepared in the examples, and flat spectra are shown through the measured wavelength range in Samples 3 and 4 using the tube prepared in the comparative example.

INDUSTRIAL APPLICABILITY

An ink reservoir for a ball point pen in which fine particle titanium oxide is blended into a resin composing the reservoir and through which light can be transmitted displays a blue color and beautiful appearance even when it was charged with an ink having a visual color which is almost close to black. In addition thereto, since it transmits light, a content of the ink can be discriminated. If a blue ink is used, a visual color of the ink reservoir is consistent with a hue of the drawn lines, and if the ball point pen ink reservoir and the holder thereof are transparent, the user can visually observe at a glance from the appearance that it is a blue color ball point pen.

What is claimed is:

1. An ink reservoir for a ball point pen comprising a resin having fine particles with an average particle diameter of 100 nm or less dispersed therein, the particles capable of scattering light.

2. The ink reservoir for a ball point pen as described in claim 1, wherein the ink reservoir is made of polypropylene.

3. A ball point pen using the ink reservoir for a ball point pen as described in claim 2, wherein the ink reservoir contains an oil based ink for a ball point pen.

4. The ball point pen as described in the claim 3, wherein the oil based ink for a ball point pen filled into the ink reservoir is a blue ink.

5. The ink reservoir for a ball point pen as described in claim 1, wherein the fine particles are titanium oxide.

6. A ball point pen using the ink reservoir for a ball point pen as described in claim 5, wherein the ink reservoir contains an oil based ink for a ball point pen.

7. The ball point pen as described in the claim 6, wherein the oil based ink for a ball point pen filled into the ink reservoir is a blue ink.

8. A ball point pen using the ink reservoir for a ball point pen as described in claim 1, wherein the ink reservoir contains an oil based ink for a ball point pen.

9. The ball point pen as described in claim 8 wherein the oil based ink for a ball point pen filled into the ink reservoir is blue ink.

10. The ink reservoir of claim 1, wherein the particles are capable of scattering visible light.

11. The ink reservoir of claim 10, wherein the light has a wavelength of 400 to 500 nm.

* * * * *